US008531371B2

(12) United States Patent
Yoon et al.

(10) Patent No.: US 8,531,371 B2
(45) Date of Patent: Sep. 10, 2013

(54) LIQUID CRYSTAL DISPLAY AND DRIVING METHOD THEREOF

(75) Inventors: Hyun-Sik Yoon, Seoul (KR); Hee-Bum Park, Seongnam-si (KR); Seung-Soo Baek, Suwon-si (KR); Dong-Gyu Kim, Yongin-si (KR); Gwon-Heon Ryu, Daegu (KR)

(73) Assignee: Samsung Display Co., Ltd., Yongin (KR)

( * ) Notice: Subject to any disclaimer, the term of this patent is extended or adjusted under 35 U.S.C. 154(b) by 522 days.

(21) Appl. No.: 12/838,829

(22) Filed: Jul. 19, 2010

(65) Prior Publication Data

US 2011/0169799 A1 Jul. 14, 2011

(30) Foreign Application Priority Data

Jan. 14, 2010 (KR) ..... 10-2010-0003600

(51) Int. Cl.
*G09G 3/36* (2006.01)

(52) U.S. Cl.
USPC ..... 345/96

(58) Field of Classification Search
USPC ..... 345/87, 92, 96
See application file for complete search history.

(56) References Cited

U.S. PATENT DOCUMENTS

| | | | | |
|---|---|---|---|---|
| 5,754,150 | A | 5/1998 | Matsui | |
| 2005/0088392 | A1 | 4/2005 | Kim et al. | |
| 2006/0152462 | A1 | 7/2006 | Furihata et al. | |
| 2007/0152936 | A1 | 7/2007 | Shin et al. | |
| 2007/0216635 | A1 | 9/2007 | Kondoh et al. | |
| 2007/0262938 | A1* | 11/2007 | Kim | 345/92 |
| 2007/0296658 | A1* | 12/2007 | Kim | 345/87 |
| 2008/0001901 | A1* | 1/2008 | Lee | 345/100 |
| 2009/0040414 | A1* | 2/2009 | Kawachi | 349/48 |
| 2009/0167659 | A1 | 7/2009 | Kim et al. | |

(Continued)

FOREIGN PATENT DOCUMENTS

| | | |
|---|---|---|
| JP | 2003-122310 | 4/2003 |
| JP | 2003-241717 | 8/2003 |

(Continued)

OTHER PUBLICATIONS

"Driving method for thin film trasistor liquid crystal display with contrast control" IBM technical disclosure bulletin, international business machines corp. (thornwood), us, vol. 37, No. 12, Dec. 1, 1994, pp. 457-459, XP000487851 ISSN: 0018-8689.

(Continued)

*Primary Examiner* — Allison Walthall
(74) *Attorney, Agent, or Firm* — H.C. Park & Associates, PLC

(57) ABSTRACT

A liquid crystal display includes a liquid crystal layer disposed between first and second substrates. A gate line transmits gate signals; a first data line transmits data voltages; a first voltage line alternately transmits a first voltage and a second voltage that is than greater than the first voltage; a first switching element is connected to the gate line and the first data line; a second switching element is connected to the gate line and the first voltage line; a first pixel electrode is connected to the first switching element; and a second pixel electrode is connected to the second switching element. The first pixel electrode and the second pixel electrode form a liquid crystal capacitor along with the liquid crystal layer, and at least one of the first voltage and the second voltage is variable.

46 Claims, 12 Drawing Sheets

(56) References Cited

U.S. PATENT DOCUMENTS

| | | | | |
|---|---|---|---|---|
| 2009/0303168 | A1* | 12/2009 | Nagata | 345/90 |
| 2010/0245405 | A1* | 9/2010 | Murai et al. | 345/690 |
| 2010/0328279 | A1* | 12/2010 | Jung et al. | 345/103 |

FOREIGN PATENT DOCUMENTS

| | | |
|---|---|---|
| JP | 2007-121832 | 5/2007 |
| JP | 2007-322691 | 12/2007 |
| KR | 1020030092552 | 12/2003 |
| KR | 100444994 | 8/2004 |
| KR | 1020060022458 | 3/2006 |
| KR | 1020070025648 | 3/2007 |
| KR | 1020070036906 | 4/2007 |
| KR | 1020070081521 | 8/2007 |
| KR | 1020080000852 | 1/2008 |

OTHER PUBLICATIONS

Extended European Search Report of Nov. 5, 2010 in European Patent Application No. 10170786.7.

* cited by examiner

LIQUID CRYSTAL DISPLAY AND DRIVING METHOD THEREOF

CROSS-REFERENCE TO RELATED APPLICATION

This application claims priority to and the benefit of Korean Patent Application No. 10-2010-0003600, filed on Jan. 14, 2010, which is hereby incorporated by reference for all purposes as if fully set forth herein.

BACKGROUND OF THE INVENTION

1. Field of the Invention

Exemplary embodiments of the present invention relate to a liquid crystal display and a driving method thereof.

2. Description of the Related Art

A liquid crystal display (LCD) is one of the most widely used flat panel displays. The LCD typically includes two display panels having electric field generating electrodes, such as pixel electrodes and a common electrode, and a liquid crystal layer interposed between the two display panels. Voltages are applied to the electric field generating electrodes to generate an electric field in the liquid crystal layer. Due to the generated electric field, liquid crystal molecules of the liquid crystal layer are aligned and polarization of incident light is controlled, thereby displaying images.

The LCD may also include switching elements connected to the respective pixel electrodes, and a plurality of signal lines, such as gate lines and data lines, for controlling the switching elements and applying voltages to the pixel electrodes.

The liquid crystal display receives an input image signal from an external graphics controller. The input image signal contains luminance information of each pixel PX, and the luminance has grays of a given quantity. Each pixel receives a data voltage corresponding to the desired luminance information. The data voltage appears as a pixel voltage according to a difference between a reference voltage, such as a common voltage, and each pixel displays luminance representing a gray of the image signal according to the pixel voltage. Here, to prevent image deterioration due to a lengthy application of a unidirectional electric field, etc., polarity of the data voltages with respect to the reference voltage may be reversed every frame, every row, or every pixel. Also, in order to prevent stains such as vertical lines in the display screen, different polarity pixel voltages may be applied to neighboring pixels.

When the polarities of neighboring data lines are different so that different polarity pixel voltages may be applied to neighboring pixels, a large voltage difference may exist between the data voltage applied to one pixel and the voltage applied to the data line connected to the neighboring pixel, thereby generating light leakage near the pixel. Particularly, the light leakage further increases as the driving voltage increases.

The above information disclosed in this Background section is only for enhancement of understanding of the background of the invention and therefore it may contain information that does not form the prior art that is already known in this country to a person of ordinary skill in the art.

SUMMARY OF THE INVENTION

Exemplary embodiments of the present invention provide a liquid crystal display that may have an increased driving voltage with reduced light leakage.

Additional features of the invention will be set forth in the description which follows, and in part will be apparent from the description, or may be learned by practice of the invention.

An exemplary embodiment of the present invention discloses a liquid crystal display including first and second substrates facing each other; a liquid crystal layer disposed between the first and second substrates and including liquid crystal molecules; a gate line disposed on the first substrate to transmit a gate signal; a first data line disposed on the first substrate to transmit a data voltage; a first voltage line disposed on the first substrate to alternately transmit a first voltage and a second voltage that is greater than the first voltage; a first switching element connected to the gate line and the first data line; a second switching element connected to the gate line and the first voltage line; a first pixel electrode connected to the first switching element; and a second pixel electrode connected to the second switching element. The first pixel electrode and the second pixel electrode form a liquid crystal capacitor along with the liquid crystal layer, and at least one of the first voltage and the second voltage is a variable voltage.

An exemplary embodiment of the present invention also discloses a method of driving a liquid crystal display including a first pixel electrode connected to a first data line through a first switching element, a second pixel electrode connected to a first voltage line through a second switching element, and a liquid crystal layer disposed between the first pixel electrode and the second pixel electrode. The method includes: turning on the first switching element to apply a data voltage to the first pixel electrode; and turning on the second switching element to alternately apply a first voltage and a second voltage that is greater than the first voltage to the second pixel electrode. At least one of the first voltage and the second voltage is a variable voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
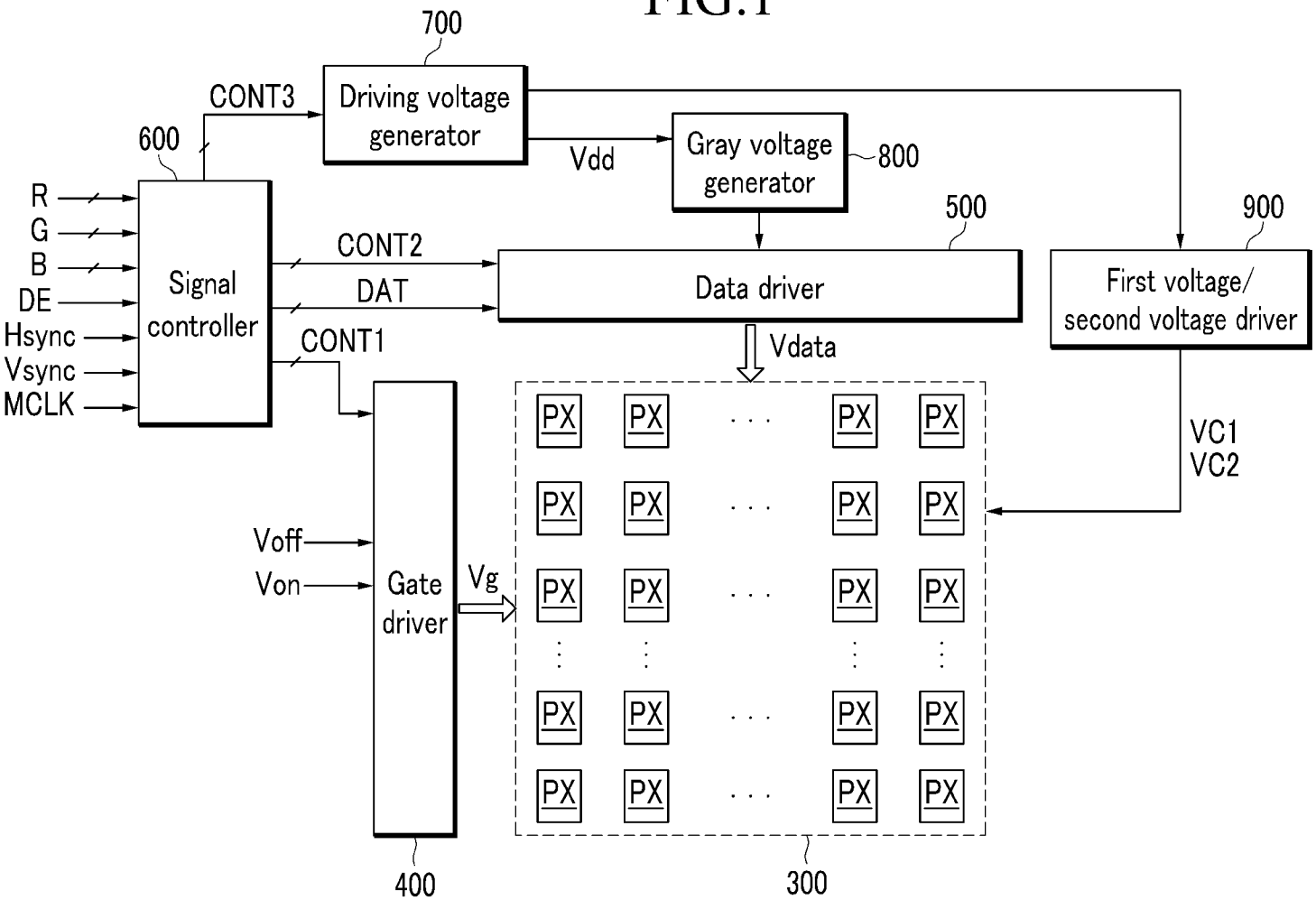
FIG. 1 is a block diagram of a liquid crystal display according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

A liquid crystal display and a driving method thereof according to an exemplary embodiment of the present invention will be described below with reference to drawings.

Figure 2:
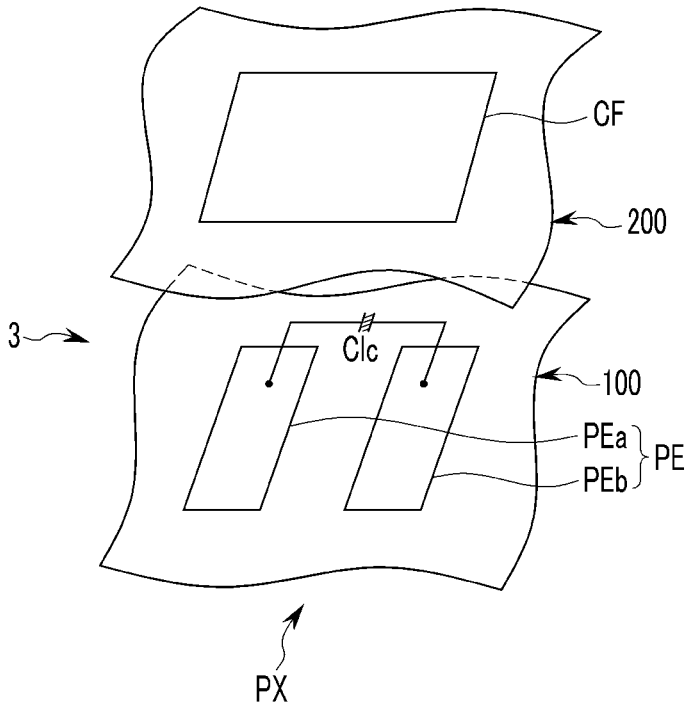
FIG. 2 is an equivalent circuit diagram of one pixel along with a structure of a liquid crystal display according to an exemplary embodiment of the present invention.
Figure 3:
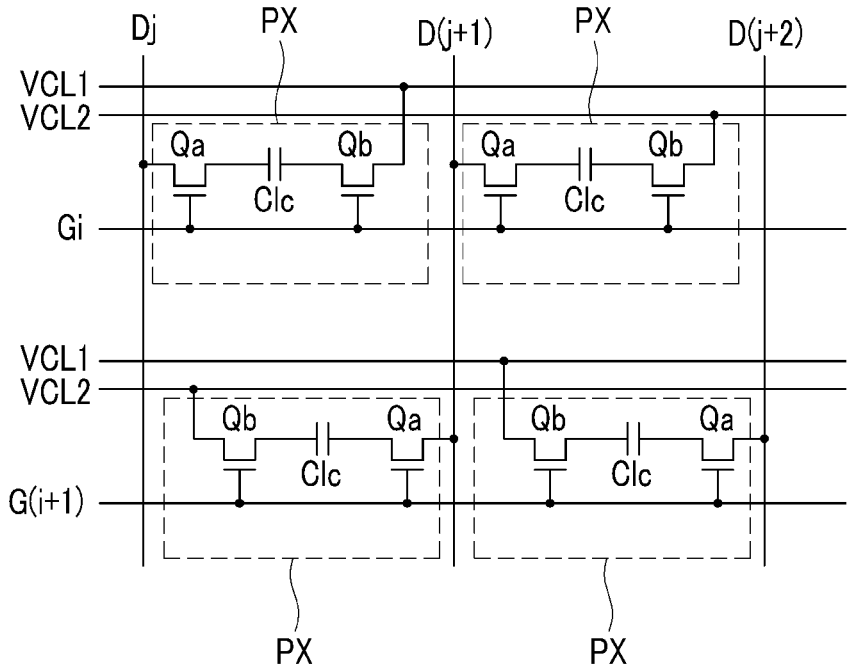
FIG. 3 is a circuit diagram showing four pixels of a liquid crystal display according to an exemplary embodiment of the present invention.

FIG. 1 is a block diagram of a liquid crystal display according to an exemplary embodiment of the present invention, FIG. 2 is an equivalent circuit diagram of one pixel along with a structure of a liquid crystal display according to an exemplary embodiment of the present invention, and FIG. 3 is a circuit diagram showing four pixels of a liquid crystal display according to an exemplary embodiment of the present invention.

Referring to FIG. 1, a liquid crystal display according to an exemplary embodiment of the present invention includes a liquid crystal panel assembly 300, a gate driver 400, a data driver 500, a driving voltage generator 700, a first voltage/second voltage driver 900, a gray voltage generator 800, and a signal controller 600.

Referring to FIG. 1 and FIG. 3, in an equivalent circuit of the liquid crystal panel assembly 300, the liquid crystal panel assembly 300 includes a plurality of signal lines G1-Gn and D1-Dm, and a plurality of pixels PX may be arranged in an approximate matrix. In the structure shown in FIG. 2, the liquid crystal panel assembly 300 includes a lower panel 100 and an upper panel 200 facing each other, and a liquid crystal layer 3 interposed therebetween.

Referring to FIG. 3, the signal lines include a plurality of gate lines Gi and G(i+1) to transmit gate signals, a plurality of data lines Dj, D(j+1) and D(j+2) to transmit data signals, which may be voltage signals, and a first voltage line VCL1 to transmit a first voltage VC1 and a second voltage line VCL2 to transmit a second voltage VC2. The gate lines Gi and G(i+1), the first voltage line VCL1, and the second voltage line VCL2 may extend substantially in the row direction and may be parallel to each other. The data lines Dj, D(j+1), and D(j+2) may extend substantially in the column direction and may be parallel to each other.

Each pixel PX, for example, a pixel PX connected to the i-th gate line Gi and the j-th data line Dj, includes a first switching element Qa connected to the gate line Gi and the data line Dj, a second switching element Qb connected to the gate line Gi and the first voltage line VCL1, and a liquid crystal capacitor Clc connected to the first and second switching elements Qa and Qb. The pixel PX connected to the i-th gate line Gi and the (j+1)-th data line D(j+1) includes the first switching element Qa connected to the gate line Gi and the data line D(j+1), the second switching element Qb connected to the gate line Gi and the second voltage line VCL2, and a liquid crystal capacitor Clc connected to the first and second switching elements Qa and Qb.

Thus, the second switching elements Qb of pixels PX neighboring in the row or column direction may be connected to different lines among the first voltage line VCL1 and the second voltage line VCL2.

The first voltage line VCL1 and the second voltage line VCL2 may be alternately applied with the first voltage VC1 and the second voltage VC2, which is greater than the first voltage VC1, every frame. Further, the voltages applied to the first voltage line VCL1 and the second voltage line VCL2 during the same frame may be different from each other. The first voltage VC1 may be a ground voltage or 0V, and the second voltage VC2 may be a driving voltage Vdd.

Referring to FIG. 2 and FIG. 3, the liquid crystal capacitor Clc includes a first pixel electrode PEa and a second pixel electrode PEb of the lower panel 100 as two terminals with the liquid crystal layer 3 between the first and second pixel electrodes PEa and PEb serving as a dielectric material. The first pixel electrode PEa is connected to the first switching element Qa, thereby receiving the data voltage, and the second pixel electrode PEb is connected to the second switching element Qb, thereby receiving the first voltage VC1 or the second voltage VC2. The first pixel electrode PEa and the second pixel electrode PEb together form one pixel electrode PE.

The liquid crystal layer 3 has dielectric anisotropy, and liquid crystal molecules 31 (see FIG. 4) of the liquid crystal layer 3 may be arranged such that their long axes are aligned vertical to surfaces of the two panels 100 and 200 in the absence of an electric field.

The first and second pixel electrodes PEa and PEb may be formed on different layers from each other, or they may be formed on the same layer. First and second storage capacitors (not shown), which serve as assistants of the liquid crystal capacitor Clc, may be formed by overlapping separate electrodes (not shown) provided on the lower panel 100 and the first and second pixel electrodes PEa and PEb with an insulator interposed therebetween.

In order to realize color display, each pixel PX may uniquely display one of primary colors (spatial division), or each pixel PX may temporally and alternately display primary colors (temporal division). The primary colors are then spatially or temporally synthesized, thereby displaying a desired color. An example of the primary colors may be the three primary colors of red, green, and blue. One example of spatial division is represented in FIG. 2, where each pixel PX includes a color filter (CF) for one of the primary colors on the region of the upper panel 200 corresponding to the first and second pixel electrodes PEa and PEb. Alternatively, the color filter CF may be formed on or below the first and second pixel electrodes PEa and PEb of the lower panel 100.

At least one polarizer (not shown) may be included in the liquid crystal panel assembly 300 to provide polarized light.

Referring again to FIG. 1, the gray voltage generator 800 may be configured to generate all gray voltages, or it may be configured to generate a predetermined number of the gray voltages (or reference gray voltages) related to transmittance of the pixels PX based on the driving voltage Vdd. The (reference) gray voltages may include one set having a positive polarity for the first voltage VC1, and another set having a negative polarity for the second voltage VC2.

The gate driver 400 is connected to a gate line of the liquid crystal panel assembly 300, and it applies a gate signal configured by a combination of a gate-on voltage Von and a gate-off voltage Voff to the gate line.

The data driver 500 is connected to the data lines of the liquid crystal panel assembly 300, and it selects a gray voltage from the gray voltage generator 800 and applies the selected gray voltage as the data voltage to the data line. However, when the gray voltage generator 800 provides of a limited number of reference gray voltages instead of all the gray voltages, the data driver 500 generates a desired data voltage by dividing the reference gray voltages.

The first voltage/second voltage driver 900 is connected to the first voltage line (not shown) and the second voltage line (not shown) of the liquid crystal panel assembly 300 and may alternately apply the first voltage VC1 and the greater second voltage VC2 to the first voltage line every frame, and may alternately apply the second voltage VC2 and the first voltage VC1 to the second voltage line every frame. The voltages applied to the first voltage line and the second voltage line during one frame may be different from each other.

The driving voltage generator 700 generates voltages required for generating the (reference) gray voltage such as the driving voltage Vdd to supply them to the gray voltage generator 800, and generates voltages required for the first voltage VC1 and the second voltage VC2 to be supplied to the first voltage/second voltage driver 900.

The signal controller 600 controls the gate driver 400, the data driver 500, and the driving voltage generator 700.

Next, a driving method of a liquid crystal display according to an exemplary embodiment of the present invention will be described with reference to FIG. 4 as well as FIG. 1, FIG. 2, and FIG. 3.

Figure 4:
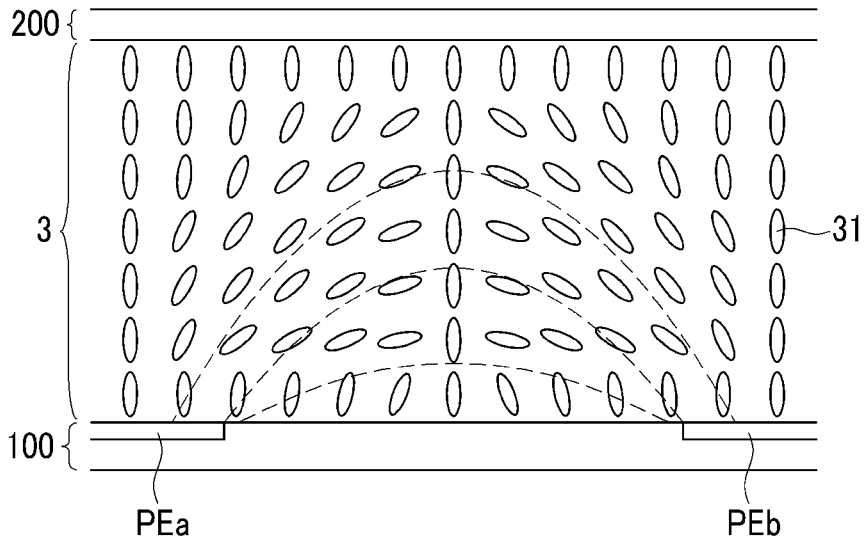
FIG. 4 is a schematic cross-sectional view of a liquid crystal display according to an exemplary embodiment of the present invention.

FIG. 4 is a cross-sectional view of a liquid crystal display according to an exemplary embodiment of the present invention.

Referring to FIG. 1, the signal controller 600 receives input image signals R, G, and B and input control signals for controlling the input image signals from an external graphics controller (not shown). The input image signals R, G, and B contain information regarding luminance of the respective pixels PX, which has a predetermined number of grays, for example $1{,}024=2^{10}$, $256=2^{8}$, or $64=2^{6}$ grays. The input control signals include vertical synchronization signals Vsync, horizontal synchronization signals Hsync, main clock signals MCLK, and data enable signals DE.

The signal controller 600, based on the received input image signals R, G, and B and input control signals, properly processes the input image signals R, G, and B in accordance with the operating conditions of the liquid crystal panel assembly 300, and generates gate control signals CONT1 and data control signals CONT2. The signal controller 600 transmits the gate control signals CONT1 to the gate driver 400 and transmits the data control signals CONT2 and the processed image signals DAT to the data driver 500. The signal controller 600 also generates the driving voltage control signal CONT3 based on the input image signal R, G, and B and the input control signals, and outputs it to the driving voltage generator 700.

Depending upon the data control signals CONT2 from the signal controller 600, the data driver 500 receives the digital image signals DAT for one row of pixels PX and selects gray voltages corresponding to the respective digital image signals DAT. The data driver 500 may convert the digital image signals DAT into analog data voltages and apply them to the relevant data lines.

Upon receipt of the gate control signals CONT1 from the signal controller 600, the gate driver 400 applies gate-on voltages Von to the gate lines so as to turn on the first and second switching elements Qa and Qb connected to the gate lines. Thus, the data voltage applied to the data line is applied to the first pixel electrode PEa of the corresponding pixel PX through the turned-on first switching element Qa, and the first voltage VC1 or the second voltage VC2 is applied to the second pixel electrode PEb through the first voltage line VCL1 or the second voltage line VCL2 and the second switching element Qb. When the voltage applied to the second pixel electrode PEb is the first voltage VC1, the data voltage applied to the first pixel electrode PEa is positive with respect to the first voltage VC1, and when the voltage applied to the second pixel electrode PEb is the second voltage VC2, the data voltage applied to the first pixel electrode PEa is negative with respect to the second voltage VC2. Consequently, the voltage difference between the first pixel electrode PEa and the second pixel electrode PEb corresponds to the luminance that the pixel PX will display.

The difference between the two voltages applied to the first and second pixel electrodes PEa and PEb is expressed as a charged voltage of the liquid crystal capacitors Clc, i.e., a pixel voltage. If a potential difference is generated between the two terminals of the liquid crystal capacitor Clc, as shown in FIG. 4, an electric field is formed in the liquid crystal layer 3 between the first and second pixel electrodes PEa and PEb. Portions of the electric field may be substantially parallel to the surface of the display panels 100 and 200. When the liquid crystal molecules 31 have positive dielectric anisotropy, the liquid crystal molecules 31 are arranged such that their long axes are aligned parallel to the direction of the electric field, and the degree of inclination changes according to the magnitude of the pixel voltage. This liquid crystal layer 3 is referred to as an electrically-induced optical compensation (EOC) mode liquid crystal layer. Also, amount of polarized light passing through the liquid crystal layer 3 changes according to the inclination degree of the liquid crystal molecules 31. The change in the amount of polarized light appears as a change of transmittance of light by the polarizer, and accordingly, the pixel PX displays the predetermined luminance corresponding to the gray of the image signal DAT.

By repeating such a process by one horizontal period (also referred to as "1H", equal to one period of the horizontal synchronization signal (Hsync) and the data enable signal DE), the gate-on signal Von is sequentially applied to all gate lines and the data voltages are applied to all pixels PX to display an image of one frame.

After one frame ends, the next frame starts. A state of an inversion signal applied to the data driver 500 is controlled so that the polarity of the data voltage applied to each pixel PX is reversed ("frame inversion"). Also, the voltages applied to the first voltage line VCL1 and the second voltage line VCL2 are controlled to be changed from the first voltage VC1 or the second voltage VC2 to the opposite voltage in the first voltage/second voltage driver 900.

At this time, the polarity of the data voltage transmitted in one data line may be periodically changed even within one frame according to a characteristic of the inversion signal of the data driver 500 (for example, row inversion and dot inversion), or the polarities of the data voltages applied to neighboring data lines Dj, D(j+1) and D(j+2) may also be different (for example, column inversion and dot inversion).

In this way, the data voltages, and the first voltage VC1 and the second voltage VC2 that determine the polarity of the data voltages applied to one pixel PX may be varied in the range of the driving voltage Vdd, such that the driving voltage may be increased, the response speed of the liquid crystal molecules may be improved, and the transmittance of the liquid crystal display may be increased.

Also, the voltages applied to the first and second pixel electrodes PEa and PEb may be decreased by a kickback voltage generated when the first and second switching elements Qa and Qb are turned off in one pixel PX, such that there is little change in the charging voltage of the pixel PX. Accordingly, the display characteristics of the liquid crystal display may be improved.

A driving method of a liquid crystal display according to an exemplary embodiment of the present invention will now be described with reference to FIG. 5 to FIG. 12, as well as FIG. 1 to FIG. 4. Many characteristics of the exemplary embodiments shown in FIG. 1 to FIG. 4 may be applied to the exemplary embodiment shown in FIG. 5 to FIG. 12.

Figure 5:
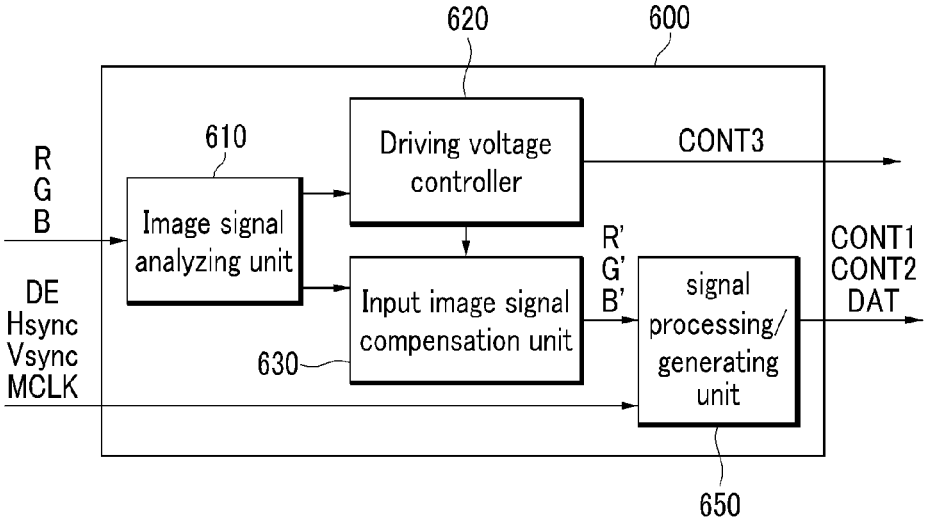
FIG. 5 is a block diagram of a liquid crystal display according to an exemplary embodiment of the present invention.
Figure 6:
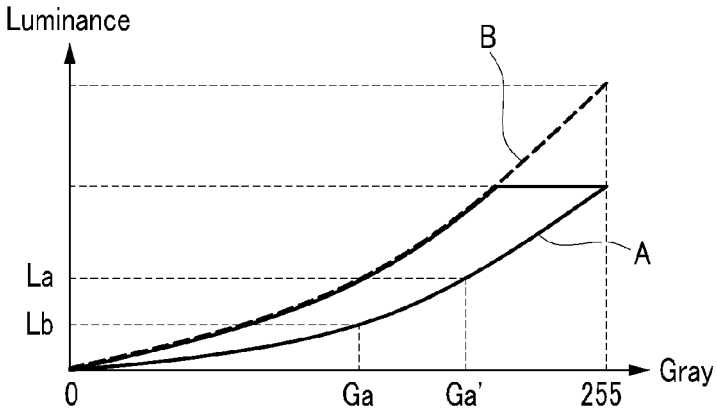
FIG. 6 shows a gray-luminance curve showing an input image signal compensation method that is executed in an input image signal compensation unit of FIG. 5.
Figure 7:
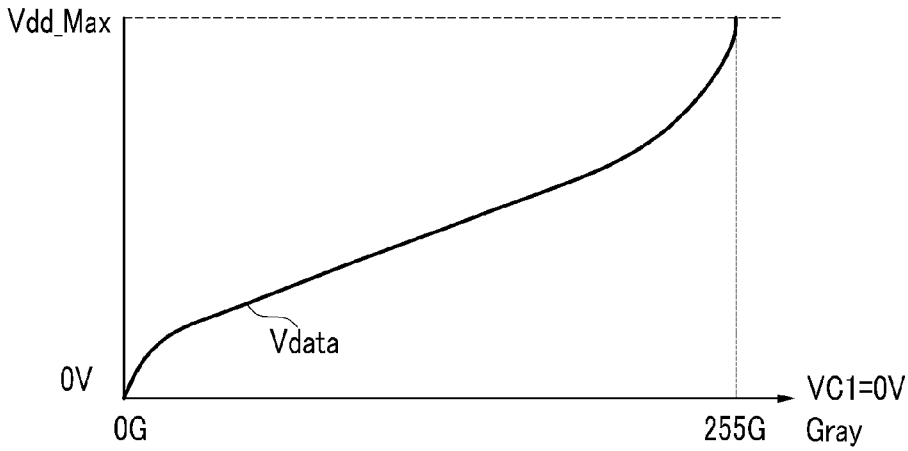
FIG. 7 and FIG. 9 are graphs showing a curve of a positive data voltage according to a gray level, and the first voltage or the second voltage in a liquid crystal display according to an exemplary embodiment of the present invention.
Figure 8:
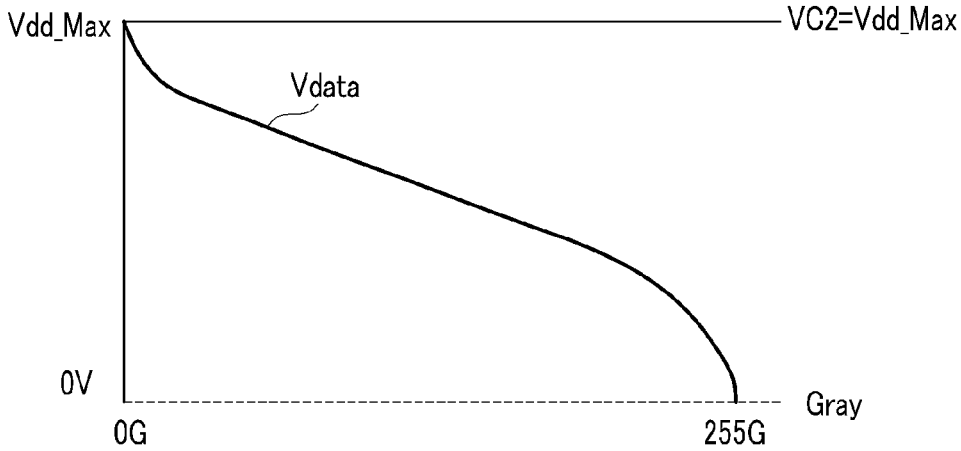
FIG. 8 and FIG. 10 are graphs showing a curve of a negative data voltage according to a gray level, and the first voltage or the second voltage in a liquid crystal display according to an exemplary embodiment of the present invention.
Figure 9:
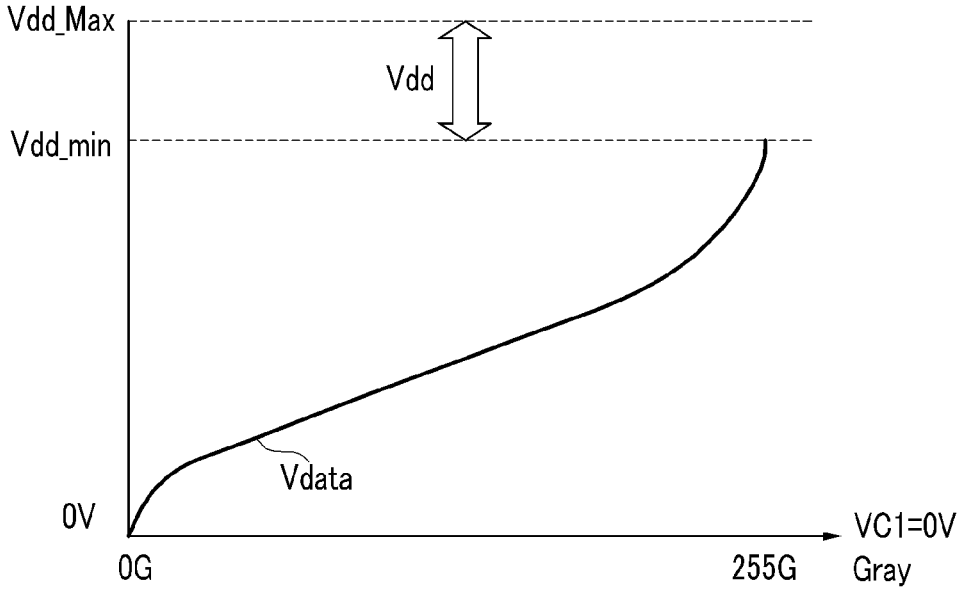
Figure 10:
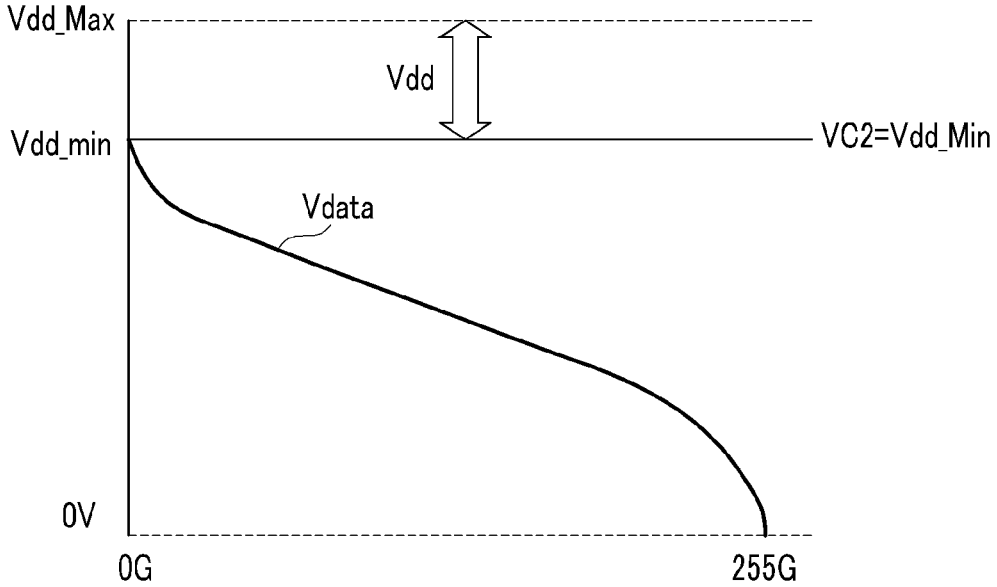
Figure 11:
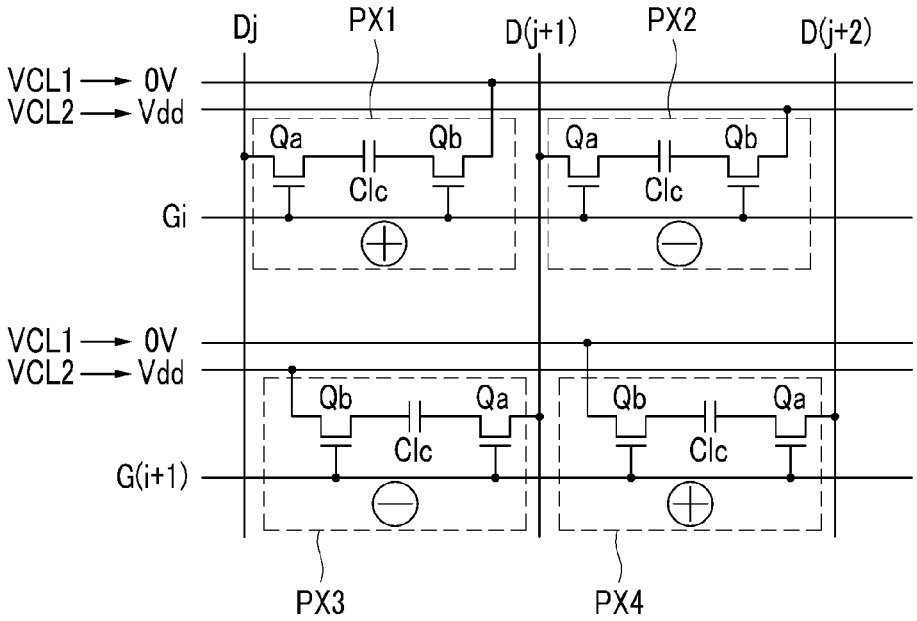
FIG. 11 and FIG. 12 are circuit diagrams showing polarity of four pixels of a liquid crystal display according to an exemplary embodiment of the present invention.
Figure 12:
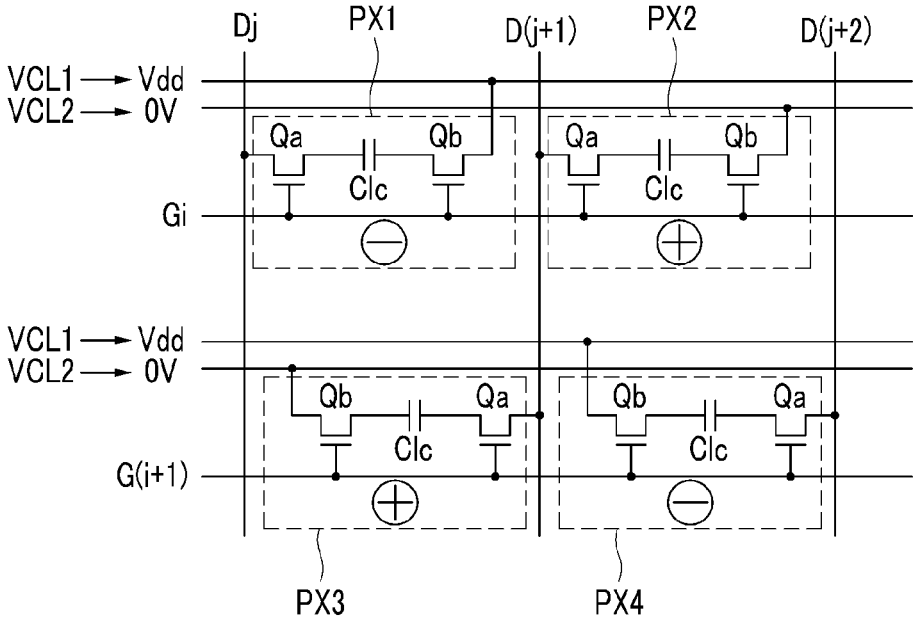

FIG. 5 is a block diagram of a liquid crystal display according to an exemplary embodiment of the present invention, FIG. 6 is a gray-luminance curve showing a input image signal compensation method that is executed in an input image signal compensation unit of FIG. 5, FIG. 7 and FIG. 9 are graphs showing a curve of a positive data voltage according to a gray, and the first voltage or the second voltage in a liquid crystal display according to an exemplary embodiment of the present invention, FIG. 8 and FIG. 10 are graphs showing a curve of a negative data voltage according to a gray, and the first voltage or the second voltage in a liquid crystal display according to an exemplary embodiment of the present invention, and FIG. 11 and FIG. 12 are circuit diagrams showing polarities of four pixels of a liquid crystal display according to an exemplary embodiment of the present invention.

In the present exemplary embodiment, the driving voltage Vdd generated in the driving voltage generator 700 according to an analysis result of the input image signal R, G, and B may change between a maximum value Vdd_Max and a minimum value Vdd_min such that the first voltage VC1 and the second voltage VC2 also swing between the ground voltage or 0V and the changed driving voltage Vdd.

Referring to FIG. 5 as well as FIG. 1, the signal controller 600 includes an image signal analyzing unit 610, a driving voltage controller 620, an input image signal compensation unit 630, and a signal processing/generating unit 650.

The image signal analyzing unit 610 receives an input image signal R, G, and B and analyses whether the screen to be displayed is white, black, or a gray between white and black.

The driving voltage controller 620 determines the driving voltage Vdd from among the maximum value Vdd_Max, the minimum value Vdd_min, or a value between the maximum value Vdd_Max and the minimum value Vdd_min according to the analysis result of the image signal analyzing unit 610, and generates a driving voltage control signal CONT3. That is, when the screen to be displayed is white, the driving voltage Vdd is determined as the maximum value Vdd_Max, when the screen to be displayed is black, the driving voltage Vdd is determined as the minimum value Vdd_min, and when the screen to be displayed is a middle gray, the driving voltage Vdd is determined as an appropriate value between the maximum value Vdd_Max and the minimum value Vdd_min. The maximum value Vdd_Max and the minimum value Vdd_min of the driving voltage Vdd may be previously determined and may be stored in an internal or external memory (not shown) of the driving voltage controller 620.

The input image signal compensation unit 630 compensates the input image signal R, G, and B based on the determined driving voltage Vdd and outputs the compensated input image signal R', G', and B' to the signal processing/generating unit 650 so that no change in luminance is generated according to the application of the changed driving voltage Vdd. This will be described with reference to FIG. 6.

In FIG. 6, curve B is a gray-luminance curve when the driving voltage Vdd is the maximum value Vdd_Max, and curve A is a gray-luminance curve when the driving voltage Vdd is less than the maximum value Vdd_Max. When the driving voltage Vdd is determined to be the maximum value Vdd_Max, compensation of the input image signal R, G, and B is not necessary. However, when the driving voltage Vdd is determined to be a value less than the maximum value Vdd_Max, the luminance displayed for the gray Ga for the same input image signal R, G, and B is the luminance Lb, which is less than the desired luminance La in curve A. Accordingly, the gray Ga of the input image signal R, G, and B should be compensated to the compensated value Ga' that can display the desired luminance La. In this way, if the input image signal R, G, and B is compensated, the desired luminance may be displayed even though the driving voltage Vdd varies.

The signal processing/generating unit 650 receives the compensated input image signal R', G', and B' and the input control signal to execute the remaining functions of the signal controller 600, which were explained in relation to the exemplary embodiment of FIG. 1. The description thereof is omitted here since it is the same as the previous description.

FIG. 7 and FIG. 8 are views showing the data voltage Vdata and the first voltage VC1 or the second voltage VC2 according to grays when representing white, and show that the driving voltage Vdd may be determined to be the maximum value Vdd_Max. FIG. 7 shows the case that the data voltage Vdata is positive with respect to the first voltage VC1 and has a value between 0V and the driving voltage Vdd, and the first voltage VC1 may be 0V. FIG. 8 shows the case that the data voltage Vdata is negative with respect to the second voltage VC2 and has the value between 0V and the driving voltage Vdd, and the second voltage VC2 may be the same as the driving voltage Vdd.

FIG. 9 and FIG. 10 are the views showing the data voltage Vdata and the first voltage VC1 or the second voltage VC2 according to grays when representing black or a gray between white and black, and show that the driving voltage Vdd may be determined to be the minimum value Vdd_min or a value between the maximum value Vdd_Max and the minimum value Vdd_min. FIG. 9 shows the case that the data voltage Vdata is positive with respect to the first voltage VC1 and has a value between 0V and the driving voltage Vdd, and the first voltage VC1 may be 0V. FIG. 10 shows the case that the data voltage Vdata is negative with respect to the second voltage VC2 and has a value between 0V and the driving voltage Vdd, and the second voltage VC2 may be equal to the driving voltage Vdd. When the display screen represents a luminance between black and white, the driving voltage Vdd may be determined to be a value between the maximum value Vdd_Max and the minimum value Vdd_min, and accordingly the permissible range of the data voltage Vdata and the value of the second voltage VC2 may be determined.

FIG. 7 to FIG. 10 show an example having 256 grays. As noted above, however, the number of grays may vary.

FIG. 11 and FIG. 12 show the polarities of four neighboring pixels PX when the first voltage line VCL1 and the second voltage line VCL2 are alternately applied with 0V and the driving voltage Vdd, which may vary every frame. Referring to FIG. 11, when the first voltage line VCL1 is applied with 0V and the second voltage line VCL2 is applied with the driving voltage Vdd in one frame, the pixels PX1 and PX4 connected to the first voltage line VCL1 are applied with the positive pixel voltage, and the pixels PX2 and PX3 connected to the second voltage line VCL2 are applied with the negative pixel voltage. Referring to FIG. 12, when the first voltage line VCL1 is applied with the driving voltage Vdd and the second voltage line VCL2 is applied with 0V in the next frame, the pixels PX1 and PX4 connected to the first voltage line VCL1 are applied with the negative pixel voltage, and the pixels PX2 and PX3 connected to the second voltage line VCL2 are applied with the positive pixel voltage.

According to the present exemplary embodiment, in the liquid crystal display in which the voltages applied to two terminals of the liquid crystal capacitor of the pixel change every frame, the driving voltage Vdd determining the maximum value of the data voltage Vdata, the first voltage VC1, or the second voltage VC2 applied to the pixel may vary according to the input image signals R, G, and B or the luminance of the display screen. Accordingly, the driving voltage Vdd may be decreased when representing black or a dark screen such that the difference between the voltage applied to one pixel and the voltage applied to the data line connected to a neighboring pixel and the swing width of the voltages applied to the first voltage line VCL1 and the second voltage line VCL2 may be reduced. Accordingly, the influence by the surrounding electric field to the voltage applied to the pixel may be reduced, such that light leakage at the surrounding of the corresponding pixel may be reduced. Here, a change of the display quality may be minimized by compensating the input image signals R, G, and B based on the changed driving voltage Vdd.

Next, a driving method of a liquid crystal display according to another exemplary embodiment of the present invention will be described with reference to FIG. 13, FIG. 14, and FIG. 15 as well as FIG. 1 to FIG. 4. Many characteristics of the exemplary embodiments shown in FIG. 1 to FIG. 4 may be applied to the exemplary embodiment shown in FIG. 13 to FIG. 15.

Figure 13:
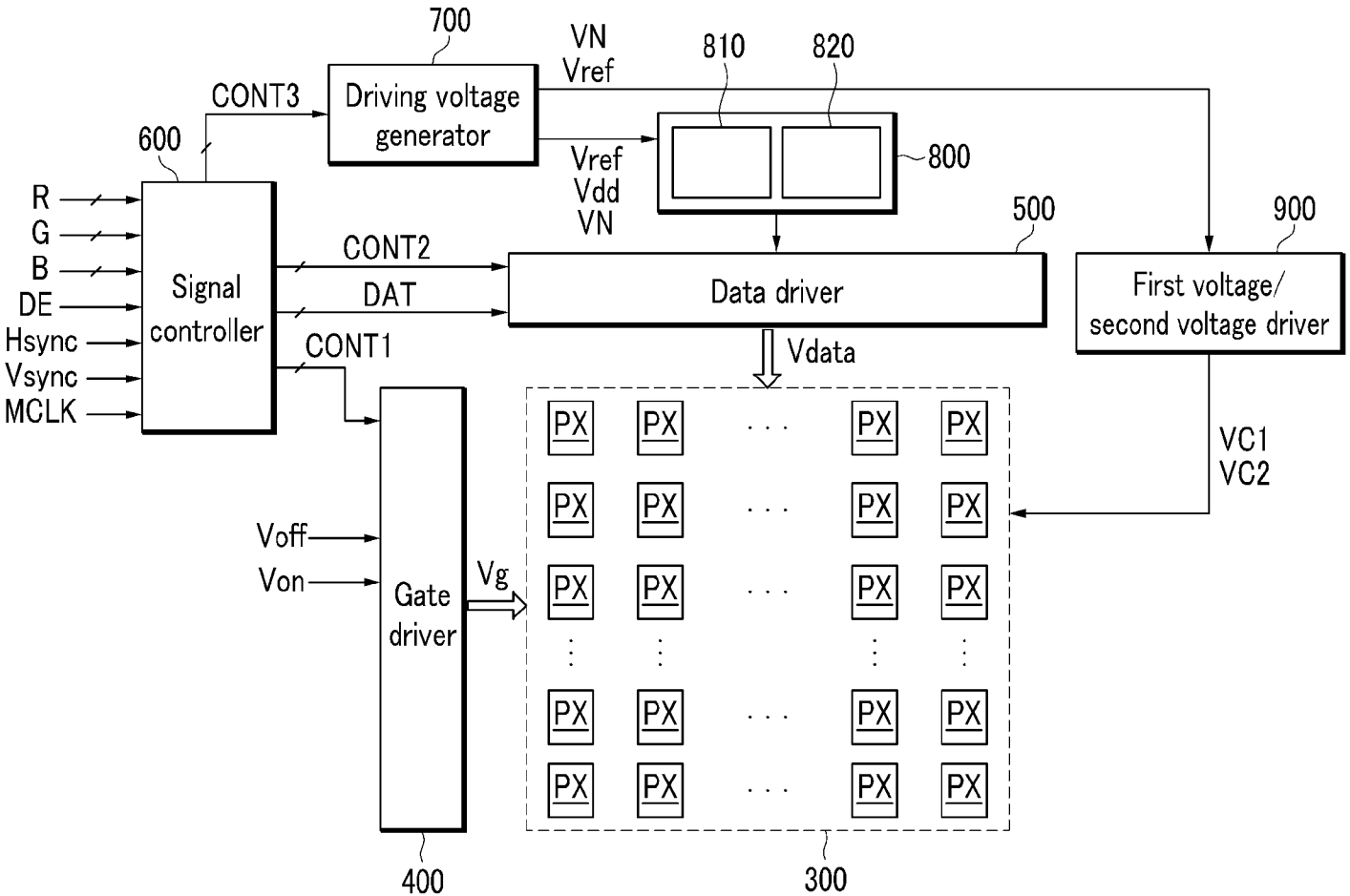
FIG. 13 is a block diagram of a liquid crystal display according to an exemplary embodiment of the present invention.
Figure 14:
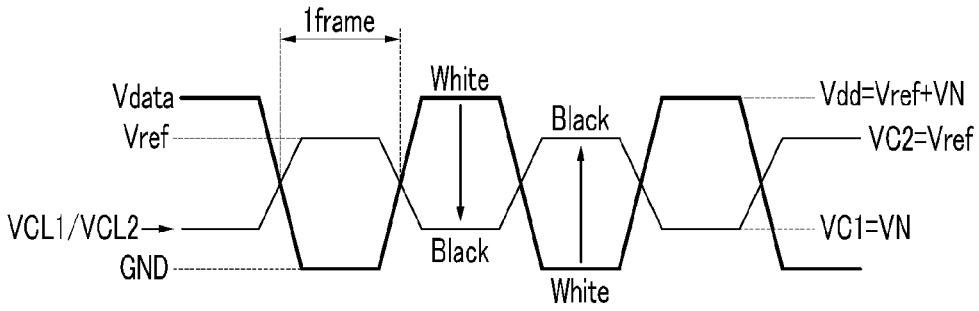
FIG. 14 is a waveform diagram according to an exemplary embodiment of the present invention showing a data voltage, the first voltage, and the second voltage in the liquid crystal display of FIG. 13.
Figure 15:
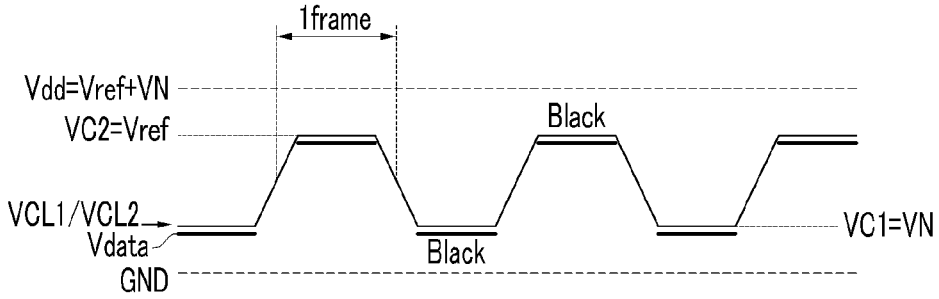
FIG. 15 is a waveform diagram according to an exemplary embodiment of the present invention showing a data voltage, the first voltage, and the second voltage when displaying a black in the liquid crystal display of FIG. 13.

FIG. 13 is a block diagram of a liquid crystal display according to an exemplary embodiment of the present invention, FIG. 14 is a waveform diagram of a data voltage, the first voltage, and the second voltage in the liquid crystal display according to the exemplary embodiment of FIG. 13, and FIG. 15 is a waveform diagram of a data voltage, the first voltage, and the second voltage when displaying a black in the liquid crystal display according to the exemplary embodiment of FIG. 13.

In the present exemplary embodiment, the driving voltage Vdd may also be changed. However, the range of the voltage is changed according to the polarity of the data voltage Vdata.

Referring to FIG. 13 along with FIG. 1, the driving voltage generator 700 transfers a reference voltage Vref, which is a standard for the variable driving voltage Vdd, and an additional voltage VN as well as the driving voltage Vdd to the gray voltage generator 800, and transfers the reference voltage Vref and the additional voltage VN to the first voltage/second voltage driver 900. The driving voltage Vdd may be a value that is the reference voltage Vref added with the additional voltage VN, and the additional voltage VN may be previously determined and stored as the value so as not to generate light leakage around the pixel when displaying the black, or may be a value determined according to the input image signals R, G, and B. The additional voltage VN may be equal to or more than 0V and less than or equal to the reference voltage Vref.

The first voltage/second voltage driver 900 applies the reference voltage Vref to the first voltage line VCL1 or the second voltage line VCL2 as the second voltage VC2, and applies the additional voltage VN to the second voltage line VCL2 or the first voltage line VCL1 as the first voltage VC1.

The gray voltage generator 800 includes a positive gray voltage generator 810 and a negative gray voltage generator 820. The positive gray voltage generator 810 generates positive gray voltages by using the driving voltage Vdd and the additional voltage VN, and the negative gray voltage generator 820 generates negative gray voltages by using the reference voltage Vref and the ground voltage GND.

Accordingly, the positive data voltage among the data voltages Vdata applied to the pixel PX may vary between the variable driving voltage Vdd and the additional voltage VN, and the negative data voltage may vary between the reference voltage Vref and the ground voltage GND. This will be described with reference to FIG. 14 and FIG. 15.

Referring to FIG. 14, when the data voltage Vdata is positive with reference to the first voltage VC1, the data voltage Vdata may vary between the driving voltage Vdd, which is the sum of the reference voltage Vref and the additional voltage VN, and the additional voltage VN. Here, the first voltage VC1 is equal to the additional voltage VN. Also, when the data voltage Vdata is negative with reference to the second voltage VC2, the data voltage Vdata may vary between the ground voltage GND and the determined reference voltage Vref, and here the second voltage VC2 is equal to the reference voltage Vref.

That is, the data voltage Vdata applied to the first pixel electrode PEa through the first switching element Qa is the driving voltage Vdd, and the first voltage VC1 applied to the second pixel electrode PEb through the second switching element Qb is the additional voltage VN in FIG. 2 and FIG. 3, when white is represented by using the positive data voltage Vdata. When white is represented by using the negative data voltage Vdata, the data voltage Vdata applied to the first pixel electrode PEa through the first switching element Qa is the driving voltage Vdd, and the second voltage VC2 applied to the second pixel electrode PEb through the second switching element Qb is the reference voltage Vref.

On the other hand, referring to FIG. 14 and FIG. 15, when representing black by using the positive data voltage Vdata, the data voltage Vdata applied to the first pixel electrode PEa through the first switching element Qa and the first voltage VC1 applied to the second pixel electrode PEb through the second switching element Qb are the additional voltage VN. When representing black by using the negative data voltage Vdata, the data voltage Vdata applied to the first pixel electrode PEa through the first switching element Qa and the second voltage VC2 applied to the second pixel electrode PEb through the second switching element Qb are the reference voltage Vref.

In FIG. 14 and FIG. 15, the waveform of the signals at the neighboring frames may be interpreted as the waveform of the signals applied to neighboring pixel PX shown in FIG. 3.

According to the present exemplary embodiment, both positive and negative data voltages may be varied with the width of the reference voltage Vref such that the changing voltage of the pixel may have a voltage from 0V to a high voltage as the reference voltage Vref. Thereby, the response speed of the liquid crystal molecule may be sufficiently improved. The voltage applied to the second pixel electrode PEb from the first voltage line VCL1 and the second voltage line VCL2 may swing between the additional voltage VN, which is equal to or more than 0V, and the reference voltage Vref such that the change width thereof may be small compared with the case that the first voltage VC1 is the ground voltage GND. Also, when representing black as in FIG. 15, the difference between the data voltage Vdata applied to one pixel PX and the data voltage Vdata applied to the data line connected to a neighboring pixel may be reduced to the value which is the reference voltage Vref subtracted by the additional voltage VN such that the influence of the surrounding electric field to the voltage applied to the pixel may be reduced, thereby improving the light leakage near the corresponding pixel. In this case, the additional voltage VN may be previously determined as the value at which the light leakage may be reduced to the desired degree, or it may have a value that is variable according to the input image signals R, G, and B.

Next, a structure of a liquid crystal display according to an exemplary embodiment of the present invention will be described with reference to FIG. 16 and FIG. 17. Many characteristics of the exemplary embodiments shown in FIG. 1 to FIG. 4 may be applied to the exemplary embodiment shown in FIG. 16 and FIG. 17.

Figure 16:
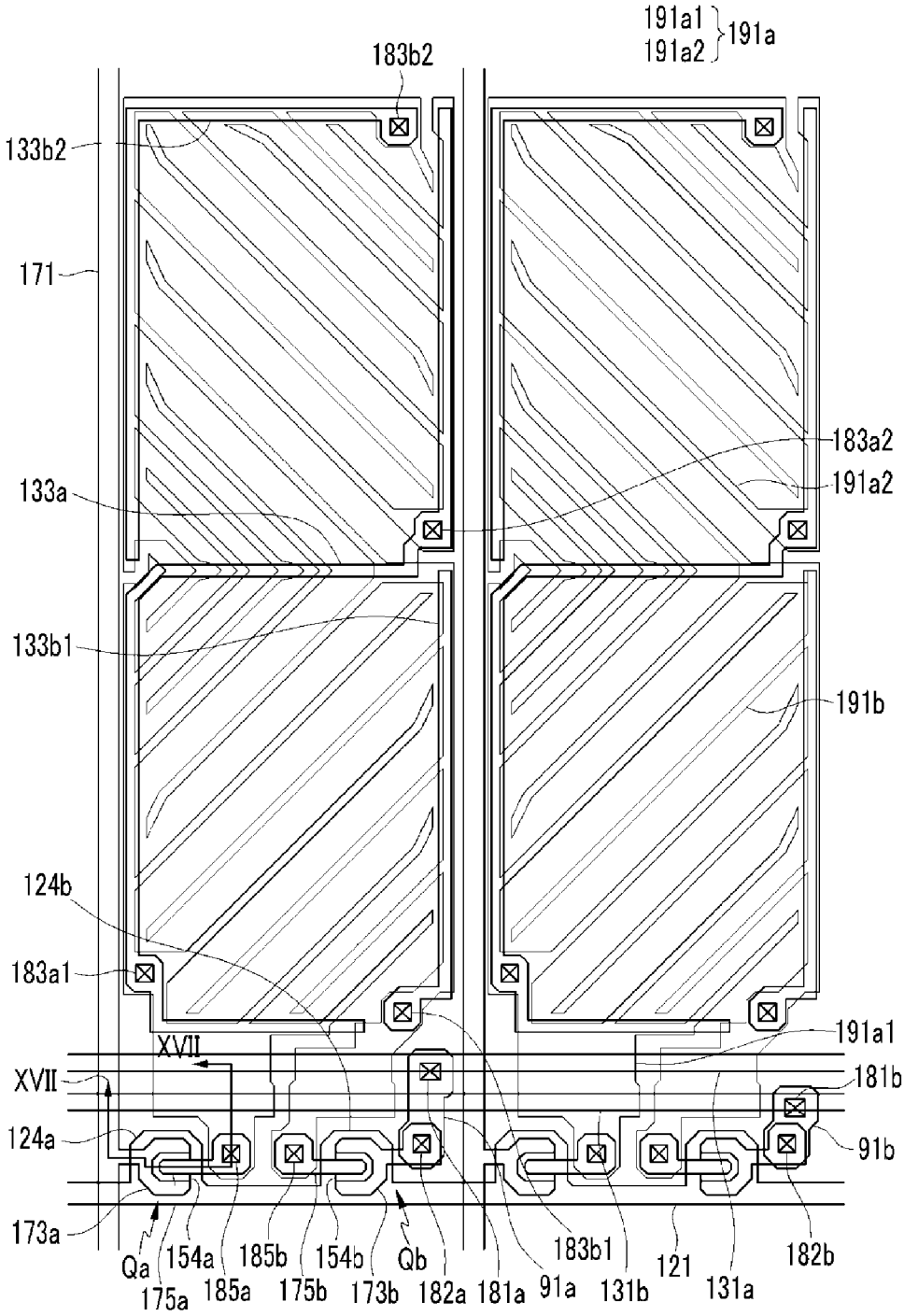
FIG. 16 is a layout view of a liquid crystal display according to an exemplary embodiment of the present invention.
Figure 17:
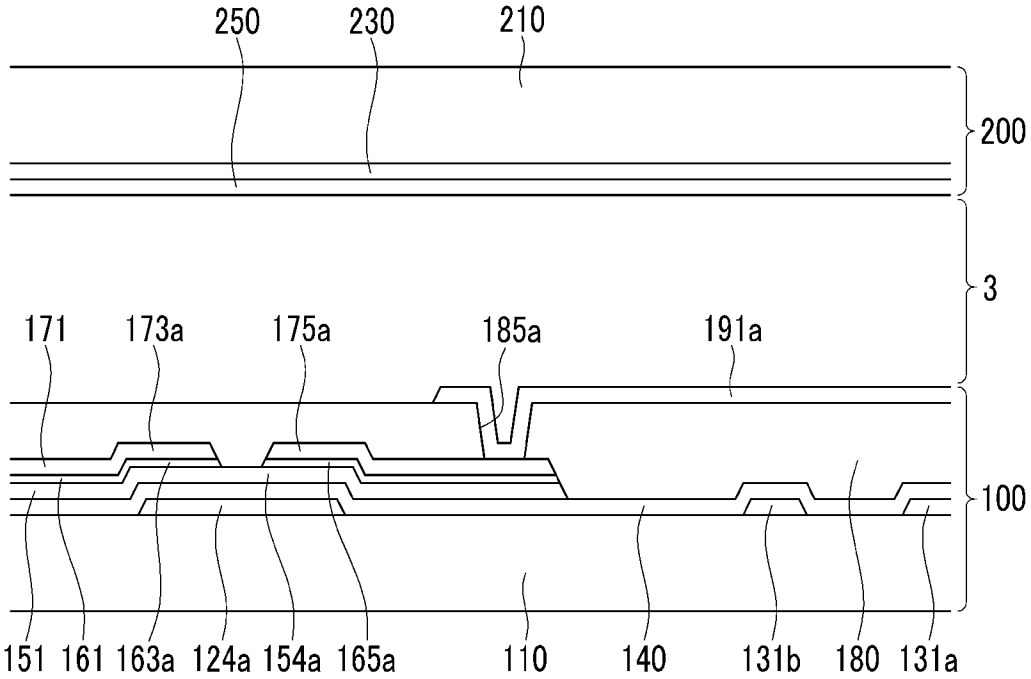
FIG. 17 is a cross-sectional view taken along line XVII-XVII of FIG. 16.

FIG. 16 is a layout view of a liquid crystal display according to an exemplary embodiment of the present invention, and FIG. 17 is a cross-sectional view of along line XVII-XVII of FIG. 16.

A liquid crystal display according to an exemplary embodiment of the present invention includes lower and upper display panels 100 and 200 facing each other, and a liquid crystal layer 3 interposed between the two panels 100 and 200.

The lower display panel 100 will be described in detail first.

A plurality of gate conductors including a plurality of gate lines 121, a plurality of pairs of first voltage lines 131*a* and second voltage lines 131*b*, and a plurality of auxiliary electrode lines 133*a*, 133*b*1, and 133*b*2 are formed on an insulation substrate 110.

The gate lines 121 transmit gate signals, and each gate line 121 includes a plurality of pairs of first and second gate electrodes 124*a* and 124*b* protruding upward.

The first voltage line 131*a* and the second voltage line 131*b* alternately receive the first voltage VC1 and the second voltage VC2 every frame, respectively, and the voltage of the first voltage line 131*a* and the voltage of the second voltage line 131*b* may be different from each other in one frame. The first voltage line 131*a* and the second voltage line 131*b* extend substantially in the horizontal direction.

The auxiliary electrode lines 133*a*, 133*b*1, and 133*b*2 are formed above the first voltage line 131*a* and the second voltage line 131*b*. Together, they may form a shape of the number "8" having angulated corners.

A gate insulating layer 140, which may be made of silicon nitride (SiNx) or silicon oxide (SiOx), is formed on the gate conductor.

A plurality of semiconductor stripes 151 and a plurality of semiconductor islands 154*b*, which may be made of hydrogenated amorphous silicon or polysilicon, are formed on the gate insulating layer 140. The semiconductor stripes 151 include a plurality of protrusions 154*a*, and the protrusion 154*a* and the semiconductor islands 154*b* are disposed on the first and second gate electrodes 124*a* and 124*b*, respectively.

Ohmic contact stripes 161 including protrusions 163*a* and ohmic contact islands 165*a* are formed on the semiconductor stripes 151, and a pair of ohmic contact islands (not shown) are also formed on the semiconductor island 154*b*. The ohmic contacts 163*a* and 165*a* may be made of a material such as n+ hydrogenated a-Si that is heavily doped with an n-type impurity such as phosphorus, or of a silicide.

A data conductor including a plurality of data lines 171, a plurality of first drain electrodes 175*a* and a plurality of second source electrodes 173*b* and a plurality of second drain electrodes 175*b* is formed on the ohmic contacts 163*a* and 165*a* and the gate insulating layer 140.

The data lines 171 transmit the data signals and extend substantially in the vertical direction thereby intersecting the gate lines 121. Each data line 171 includes a plurality of first source electrodes 173*a* protruding toward the first gate electrodes 124*a*.

The first and second drain electrodes 175*a* and 175*b* have a bar type end that faces the first and second source electrodes 173*a* and 173*b* with respect to the first and second gate electrodes 124*a* and 124*b*, and portions of the bar type end are enclosed by the first and second source electrodes 173*a* and 173*b*.

The first/second gate electrode 124*a*/124*b*, the first/second source electrode 173*a*/173*b*, and the first/second drain electrode 175*a*/175*b* form the first/second thin film transistor (TFT) Qa/Qb along with the protrusion/semiconductor island 154*a*/154*b*. The channel of the first/second thin film transistor Qa/Qb is formed in the portion of the protrusion/semiconductor island 154*a*/154*b* disposed between the first/second source electrode 173*a*/173*b* and the first/second drain electrode 175*a*/175*b*.

The ohmic contacts 163*a* and 165*a* are only disposed between the underlying semiconductors 151 and 154*b* and the overlying data conductors 171, 173*b*, 175*a*, and 175*b*, thereby reducing the resistance therebetween.

A passivation layer 180 is formed on the data conductor 171, 173*b*, 175*a* and 175*b* and the exposed semiconductors 151 and 154*b*.

The passivation layer 180 has a plurality of contact holes 185*a* and 185*b* respectively exposing a portion of the first and second drain electrodes 175*a* and 175*b*, and a plurality of contact holes 182*a* and 182*b* respectively exposing a portion of the second source electrodes 173*b*. The passivation layer 180 and the gate insulating layer 140 have contact holes 181*a* and 181*b* exposing portions of the first voltage line 131*a* and the second voltage line 131*b*, respectively, contact holes 183*a*1 and 183*a*2 exposing portions of the auxiliary electrode lines 133*a*, and contact holes 183*b*1 and 183*b*2 exposing a portion of the auxiliary electrode lines 133*b*1 and 133*b*2, respectively.

A plurality of pairs of a first pixel electrode 191*a* and a second pixel electrode 191*b*, which may be made of a transparent conductive material such as indium tin oxide (ITO) or indium zinc oxide (IZO) or a reflective metal such as aluminum, silver, chromium, or alloys thereof, are formed on the passivation layer 180. Connectors 91*a* and 91*b*, which may be made of the same material used to form the first pixel electrode 191*a* and the second pixel electrode 191*b*, are also formed on the passivation layer 180. Connector 91*a* couples the second source electrode 173*b* in a pixel with the first voltage line 131*a* via contact holes 182*a* and 181*a*, and connector 91*b* couples the second source electrode 173*a* in an adjacent pixel with the second voltage line 131*b* via contact holes 182*b* and 181*b*.

The overall contour of the first and second pixel electrodes 191*a* and 191*b* has a quadrangle shape, and the first and second pixel electrodes 191*a* and 191*b* engage with each other with gaps therebetween. The first and second pixel electrodes 191*a* and 191*b* are generally vertically symmetrical with each other with respect to a virtual transverse center line (not shown), and are divided into two sub-regions disposed up and down.

The first pixel electrode 191*a* includes two portions 191*a*1 and 191*a*2 that are separated in the upper and lower regions, and includes a lower protrusion, two longitudinal stems, and a plurality of branches. The inclined angle of the branches with respect to the gate lines 121 may be about 45 degrees. Two portions of the first pixel electrode 191*a* are connected to the auxiliary electrode lines 133*a* through the contact holes 183*a*1 and 183*a*2, and the longitudinal stem overlaps the auxiliary electrode line 133*a*, thereby preventing light leakage.

The second pixel electrode 191*b* includes a lower protrusion, two longitudinal stems, one transverse stem, and a plurality of branches. The inclined angle of the branches with respect to the gate lines 121 may also be about 45 degrees. The second pixel electrode 191*b* is connected to the auxiliary electrode lines 133*b*1 and 133*b*2 through the contact holes 183*b*1 and 183*b*2, and the longitudinal stem overlaps the auxiliary electrode line 133*b*1 and 133*b*2, thereby preventing light leakage.

The branches of the first and second pixel electrodes 191*a* and 191*b* engage with each other with a predetermined gap and are alternately disposed, thereby forming a pectinated pattern.

However, the shape of the first and second pixel electrodes 191*a* and 191*b* of the liquid crystal display according to an exemplary embodiment of the present invention is not limited thereto, and they may have various shapes.

The first and second pixel electrodes 191*a* and 191*b* are physically and electrically connected to the first and second drain electrodes 175*a* and 175*b* through the contact holes 185*a* and 185*b*, respectively. The first pixel electrode 191*a* receives the data voltage from the first drain electrode 175*a*. The second pixel electrode 191*b* receives the first voltage VC1 or the second voltage VC2 from the second drain electrode 175*b*, which is connected to the first voltage line 131*a* through the connector 91*a* and contact holes 181*a* and 182*a* or to the second voltage line 131*b* through the connector 91*b* and contact holes 181*b* and 182*b*.

The first and second pixel electrodes 191*a* and 191*b* form the liquid crystal capacitor Clc along with the liquid crystal layer 3 such that the applied voltage is maintained after the first and second thin film transistors Qa and Qb are turned off.

Next, the upper panel 200 will be described.

A plurality of color filters 230 are formed on an insulation substrate 210. Each color filter 230 may display one of primary colors such as three primary colors of red, green, and blue. A light blocking member (not shown) may be further formed on or under the color filters 230.

An overcoat 250 is formed on the color filters 230. The overcoat 250 may be made of an (organic) insulating material, and it prevents the color filters 230 from being exposed and provides a flat surface. The overcoat 250 may be omitted.

According to exemplary embodiments of the present invention, when representing a black or dark screen, the difference between the voltage applied to one pixel and the voltage applied to the data line connected to the neighboring pixel may be reduced by decreasing a driving voltage Vdd or by reducing a difference between the first voltage and the second voltage. Accordingly, light leakage near the corresponding pixel may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a first substrate and a second substrate facing each other;

a liquid crystal layer disposed between the first substrate and the second substrate and comprising liquid crystal molecules;

a gate line disposed on the first substrate, the gate line to transmit a gate signal;

a first data line disposed on the first substrate, the first data line to transmit a data voltage, the data voltage being generated at a data driver;

a first voltage line disposed on the first substrate, the first voltage line to alternately transmit a first voltage and a second voltage that is greater than the first voltage, the first voltage and the second voltage being generated at a voltage generator different from the data driver;

a first switching element connected to the gate line and the first data line; a second switching element connected to the gate line and the first voltage line; a first pixel electrode connected to the first switching element; and a second pixel electrode connected to the second switching element, wherein the first pixel electrode and the second pixel electrode form a liquid crystal capacitor along with the liquid crystal layer, and at least one of the first voltage and the second voltage is a variable voltage based on an analysis of an input image signal.

2. The liquid crystal display of claim 1, wherein a driving voltage of the liquid crystal display is a variable voltage.

3. The liquid crystal display of claim 2, wherein:

the data voltage comprises a first data voltage that has a positive polarity with respect to the first voltage and a second data voltage that has a negative polarity with respect to the second voltage.

4. The liquid crystal display of claim 3, further comprising a second data line, wherein polarities of data voltages transmitted to the first data line and the second data line are opposite to each other.

5. The liquid crystal display of claim 4, further comprising:

a second voltage line disposed on the first substrate to alternately transmit the first voltage and the second voltage;

a third switching element connected to the gate line and the second data line;

a fourth switching element connected to the gate line and the second voltage line;

a third pixel electrode connected to the third switching element; and a fourth pixel electrode connected to the fourth switching element, wherein a voltage applied to the first voltage line and a voltage applied to the second voltage line are different from each other.

6. The liquid crystal display of claim 1, wherein the data voltage comprises a first data voltage that has a positive polarity with respect to the first voltage and a second data voltage that has a negative polarity with respect to the second voltage.

7. The liquid crystal display of claim 1, further comprising a second data line, wherein polarities of data voltages transmitted to the first data line and the second data line are opposite to each other.

8. The liquid crystal display of claim 7, further comprising:

a second voltage line disposed on the first substrate to alternately transmit the first voltage and the second voltage;

a third switching element connected to the gate line and the second data line;

a fourth switching element connected to the gate line and the second voltage line;

a third pixel electrode connected to the third switching element; and a fourth pixel electrode connected to the fourth switching element, wherein a voltage applied to the first voltage line and a voltage applied to the second voltage line are different from each other.

9. The liquid crystal display of claim 1, wherein the first voltage and the second voltage are alternately applied to the first voltage line per frame.

10. The liquid crystal display of claim 1, wherein a driving voltage of the liquid crystal display varies from a maximum value to a minimum value.

11. The liquid crystal display of claim 10, wherein the first voltage is equal to a ground voltage, and the second voltage is equal to the driving voltage.

12. The liquid crystal display of claim 11, further comprising: an image signal analyzing unit to analyze the input image signal;

a driving voltage controller to change a value of the driving voltage based on an analysis result of the image signal analyzing unit, the changed driving voltage being in a range from the maximum value to the minimum value; and an input image signal compensation unit to compensate the input image signal according to the changed driving voltage.

13. The liquid crystal display of claim 12, wherein the input image signal compensation unit is configured to compensate the input image signal so that a luminance represented by the input image signal is the same as a luminance represented by the compensated input image signal according to the changed driving voltage when the driving voltage is the maximum value.

14. The liquid crystal display of claim 13, wherein the driving voltage is the minimum value when representing the color black.

15. The liquid crystal display of claim 14, wherein the data voltage comprises a first data voltage that has a positive polarity with respect to the first voltage and a second data voltage that has a negative polarity with respect to the second voltage.

16. The liquid crystal display of claim 10, further comprising:

an image signal analyzing unit to analyze the input image signal;

a driving voltage controller to change a value of the driving voltage based on an analysis result of the image signal analyzing unit, the changed driving voltage being in a range from the maximum value to the minimum value; and an input image signal compensation unit to compensate the input image signal according to the changed driving voltage.

17. The liquid crystal display of claim 16, wherein the input image signal compensation unit is configured to compensate the input image signal so that a luminance represented by the input image signal is the same as a luminance represented by the compensated input image signal according to the changed driving voltage when the driving voltage is the maximum value.

18. The liquid crystal display of claim 10, wherein the driving voltage is the minimum value when representing the color black.

19. The liquid crystal display of claim 10, wherein the data voltage comprises a first data voltage that has a positive polarity with respect to the first voltage and a second data voltage that has a negative polarity with respect to the second voltage.

20. The liquid crystal display of claim 10, wherein the first voltage and the second voltage are alternately applied to the first voltage line per frame.

21. The liquid crystal display of claim 1, wherein a driving voltage of the liquid crystal display equals a sum of a reference voltage and an additional voltage, the additional voltage being a variable voltage that is greater than or equal to 0V.

22. The liquid crystal display of claim 21, wherein the first voltage is equal to the additional voltage, and the second voltage is equal to the reference voltage.

23. The liquid crystal display of claim 22, wherein the data voltage comprises a first data voltage that has a positive polarity with respect to the first voltage and a second data voltage that has a negative polarity with respect to the second voltage, the first data voltage is greater than or equal to the additional voltage and less than or equal to the driving voltage, and the second data voltage is greater than or equal to a ground voltage and less than or equal to the reference voltage.

24. The liquid crystal display of claim 21, wherein the data voltage comprises a first data voltage that has a positive polarity with respect to the first voltage and a second data voltage that has a negative polarity with respect to the second voltage, the first data voltage is greater than or equal to the additional voltage and less than or equal to the driving voltage, and the second data voltage is greater than or equal to a ground voltage and less than or equal to the reference voltage.

25. A method of driving a liquid crystal display comprising a first pixel electrode connected to a first data line through a first switching element, a second pixel electrode connected to a first voltage line through a second switching element, and a liquid crystal layer disposed between the first pixel electrode and the second pixel electrode, the method comprising:

generating a data voltage at a data driver;

turning on the first switching element to apply the data voltage to the first pixel electrode;

generating a first voltage and a second voltage that is greater than the first voltage at a voltage generator different from the data driver; and turning on the second switching element to alternately apply the first voltage and the second voltage to the second pixel electrode, wherein at least one of the first voltage and the second voltage is a variable voltage based on an analysis of an input image signal.

26. The method of claim 25, wherein a driving voltage of the liquid crystal display is a variable voltage.

27. The method of claim 26, wherein the data voltage comprises a first data voltage that has a positive polarity with respect to the first voltage and a second data voltage that has a negative polarity with respect to the second voltage.

28. The method of claim 27, further comprising a second data line, wherein polarities of data voltages transmitted to the first data line and the second data line are opposite to each other.

29. The liquid crystal display of claim 25, wherein the data voltage comprises a first data voltage that has a positive polarity with respect to the first voltage and a second data voltage that has a negative polarity with respect to the second voltage.

30. The liquid crystal display of claim 25, further comprising a second data line, wherein polarities of data voltages transmitted to the first data line and the second data line are opposite to each other.

31. The method of claim 25, wherein the first voltage and the second voltage are alternately applied to the first voltage line per frame.

32. The method of claim 25, wherein a driving voltage of the liquid crystal display varies from a maximum value to a minimum value.

33. The liquid crystal display of claim 32, wherein the first voltage is equal to a ground voltage, and the second voltage is equal to the driving voltage.

34. The method of claim 33, further comprising:

analyzing the input image signal;

changing the driving voltage based on an analysis result of the input image signal, the changed driving voltage being in a range from the maximum value to the minimum value; and compensating the input image signal according to the changed driving voltage.

35. The method of claim 34, wherein compensating the input image signal comprises compensating the input image signal so that a luminance represented by the input image signal is the same as a luminance represented by the compensated input image signal according to the changed driving voltage when the driving voltage is the maximum value.

36. The method of claim 35, wherein the driving voltage is the minimum value when representing the color black.

37. The method of claim 36, wherein the data voltage comprises a first data voltage that has a positive polarity with respect to the first voltage and a second data voltage that has a negative polarity with respect to the second voltage.

38. The method of claim 32, further comprising:

analyzing the input image signal;

changing the driving voltage based on an analysis result of the input image signal, the changed driving voltage being in a range from the maximum value to the minimum value; and compensating the input image signal according to the changed driving voltage.

39. The method of claim 38, wherein compensating the input image signal comprises compensating the input image signal so that a luminance represented by the input image signal is the same as a luminance represented by the compensated input image signal according to the changed driving voltage when the driving voltage is the maximum value.

40. The method of claim 32, wherein the driving voltage is the minimum value when representing the color black.

41. The method of claim 32, wherein the data voltage comprises a first data voltage that has a positive polarity with respect to the first voltage and a second data voltage that has a negative polarity with respect to the second voltage.

42. The method of claim 32, wherein the first voltage and the second voltage are alternately applied to the first voltage line per frame.

43. The method of claim 25, wherein a driving voltage of the liquid crystal display equals a sum of a reference voltage and an additional voltage, the additional voltage being a variable voltage that is greater than or equal to 0V.

44. The method of claim 43, wherein the first voltage is the additional voltage, and the second voltage is the reference voltage.

45. The method of claim 44, wherein the data voltage comprises a first data voltage that has a positive polarity with respect to the first voltage and a second data voltage that has a negative polarity with respect to the second voltage, the first data voltage is greater than or equal to the additional voltage and less than or equal to the driving voltage, and the second data voltage is greater than or equal to a ground voltage and less than or equal to the reference voltage.

46. The method of claim 43, wherein the data voltage comprises a first data voltage that has a positive polarity with respect to the first voltage and a second data voltage that has a negative polarity with respect to the second voltage, the first data voltage is greater than or equal to the additional voltage and less than or equal to the driving voltage, and the second data voltage is greater than or equal to a ground voltage and less than or equal to the reference voltage.

* * * * *